US010711593B2

(12) United States Patent
Gao et al.

(10) Patent No.: US 10,711,593 B2
(45) Date of Patent: Jul. 14, 2020

(54) LOCATING A DOWNHOLE TOOL IN A WELLBORE

(71) Applicant: Halliburton Energy Services, Inc., Houston, TX (US)

(72) Inventors: Li Gao, Katy, TX (US); Krishna Ravi, Kingwood, TX (US); Batakrishna Mandal, Missouri City, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 541 days.

(21) Appl. No.: 15/315,836

(22) PCT Filed: Jun. 5, 2014

(86) PCT No.: PCT/US2014/041114
§ 371 (c)(1),
(2) Date: Dec. 2, 2016

(87) PCT Pub. No.: WO2015/187165
PCT Pub. Date: Dec. 10, 2015

(65) Prior Publication Data

US 2017/0096891 A1 Apr. 6, 2017

(51) Int. Cl.

| | |
|---|---|
| ***E21B 47/18*** | (2012.01) |
| ***E21B 47/09*** | (2012.01) |
| ***E21B 33/16*** | (2006.01) |
| ***E21B 33/12*** | (2006.01) |
| ***E21B 47/16*** | (2006.01) |
| *E21B 33/14* | (2006.01) |

(52) U.S. Cl.
CPC ..... *E21B 47/091* (2013.01); *E21B 33/1208* (2013.01); *E21B 33/16* (2013.01); *E21B 47/16* (2013.01); *E21B 47/18* (2013.01); *E21B 47/187* (2013.01); *E21B 33/14* (2013.01)

(58) Field of Classification Search
CPC ..... E21B 47/091; E21B 47/16; E21B 47/18; E21B 47/187; E21B 33/1208; E21B 33/16; E21B 33/14
See application file for complete search history.

(56) References Cited

U.S. PATENT DOCUMENTS 2,985,822 A * 5/1961 Georgi ..... E21B 47/0905 324/221
4,808,925 A 2/1989 Baird
(Continued)

FOREIGN PATENT DOCUMENTS

WO 2015187165 A1 12/2015

*Primary Examiner* — Robert E Fuller
*Assistant Examiner* — Christopher J Sebesta
(74) *Attorney, Agent, or Firm* — John W. Wustenberg; Parker Justiss, P.C.

(57) ABSTRACT

A downhole cement plug includes a casing collar locator (CCL) operable to generate signals indicative of casing collars on a downhole casing string of a wellbore system; a controller communicably coupled to the CCL to output a plurality of distinct frequency signals based on the signals from the casing collar locator; and a signal generator communicably coupled to the controller to receive the plurality of distinct frequency signals from the controller and transmit the plurality of distinct frequency signals to a terranean surface through a portion of a wellbore system.

27 Claims, 7 Drawing Sheets

(56) References Cited

U.S. PATENT DOCUMENTS

| | | | | |
|---|---|---|---|---|
| 5,995,449 | A * | 11/1999 | Green | E21B 23/04 367/83 |
| 6,354,146 | B1 * | 3/2002 | Birchak | E21B 47/101 73/61.79 |
| 2003/0010495 | A1 | 1/2003 | Mendez et al. | |
| 2003/0233873 | A1 * | 12/2003 | Standen | E21B 47/16 73/152.48 |
| 2008/0272931 | A1 * | 11/2008 | Auzerais | E21B 33/16 340/854.7 |
| 2009/0078413 | A1 | 3/2009 | Tubel et al. | |
| 2010/0051265 | A1 * | 3/2010 | Hurst | E21B 43/1185 166/250.01 |
| 2011/0139447 | A1 | 6/2011 | Ramos et al. | |
| 2013/0249705 | A1 | 9/2013 | Sharp et al. | |
| 2014/0131035 | A1 * | 5/2014 | Entchev | E21B 43/263 166/255.1 |
| 2014/0198617 | A1 * | 7/2014 | Noui-Mehidi | E21B 47/04 367/81 |
| 2014/0251603 | A1 * | 9/2014 | Raducanu | E21B 47/09 166/255.1 |

* cited by examiner

LOCATING A DOWNHOLE TOOL IN A WELLBORE

CROSS-REFERENCE TO RELATED APPLICATION

This application is the National Stage of, and therefore claims the benefit of, International Application No. PCT/US2014/041114 filed on Jun. 5, 2014, entitled "LOCATING A DOWNHOLE TOOL IN A WELLBORE," which was published in English under International Publication Number WO 2015/187165 on Dec. 10, 2015. The above application is commonly assigned with this National Stage application and is incorporated herein by reference in its entirety.

TECHNICAL BACKGROUND

This disclosure relates to locating a downhole tool in a wellbore.

BACKGROUND

Many primary cement jobs are performed by pumping displacement fluid down the casing, which leads to the displacement of a top plug. One of the challenges in primary cementing is to accurately determine how much displacement fluid to pump in front of the top plug. The challenge is mainly due to the uncertainty introduced by the conventional method of determining the volume of the displacement fluid from the casing inner diameter (ID) and the casing length. Drilling at increasing depths increases, for example, errors associated with the assumptions that the casing ID is uniform and the fluids are incompressible, as well as uncertainty of a location of the top plug in the wellbore. In some cases, the conventional method of determining the volume of the displacement fluid leads to either under displacement or over displacement of fluid. Both under and over displacement of fluid can pose a risk to the success of primary cementing.

DETAILED DESCRIPTION

Figure 1:
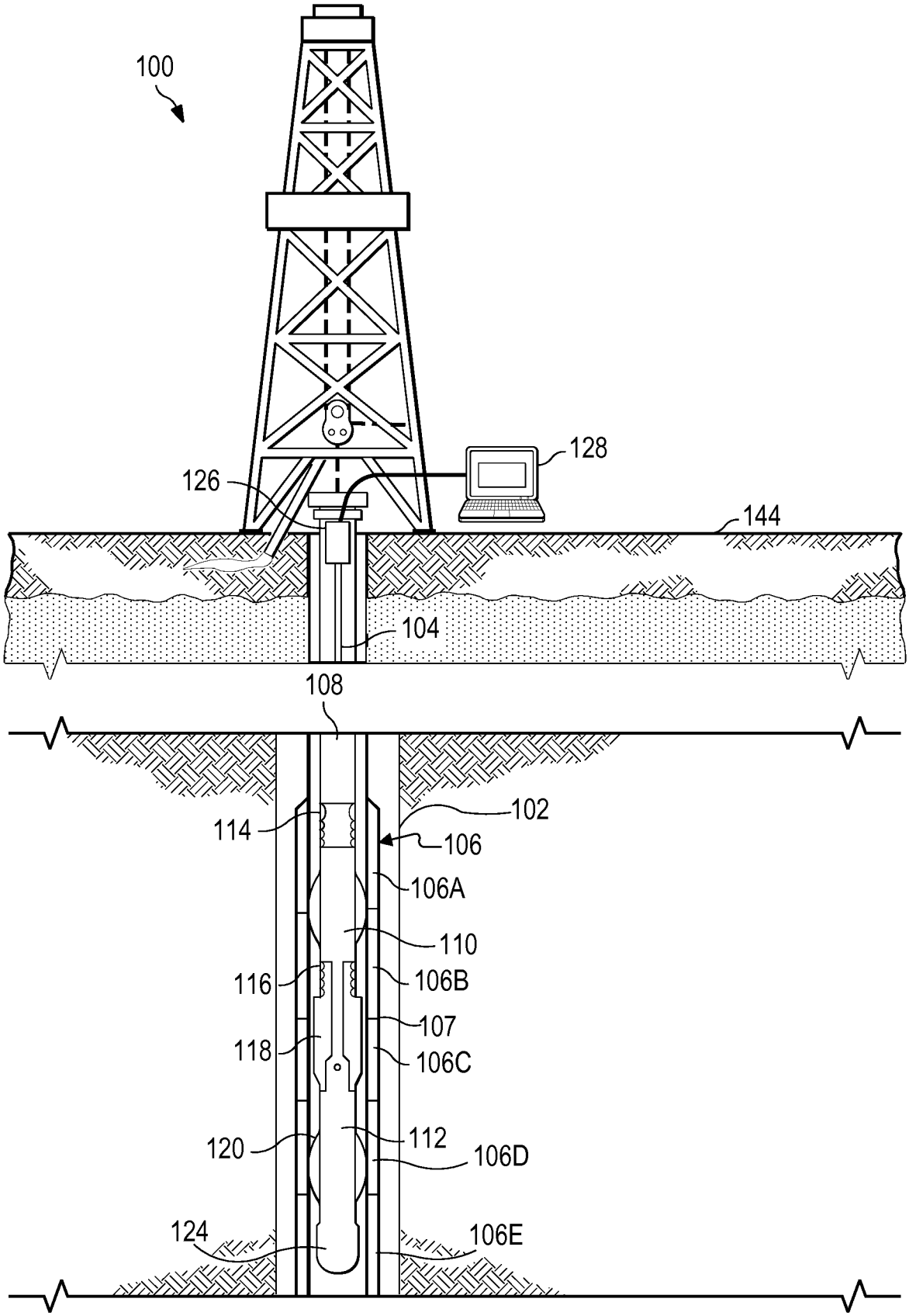
FIG. 1 is a schematic cross-sectional side view of a well system with an example locatable downhole tool.

The present disclosure relates to locating a downhole tool in a wellbore, such as, for example, a cement plug that is operable to transmit one or more signals associated with a location of the plug in the wellbore to a terranean surface. In a general implementation, a downhole cement plug includes a casing collar locator (CCL) operable to generate signals indicative of casing collars on a downhole casing string of a wellbore system; a controller communicably coupled to the CCL to output a plurality of distinct frequency signals based on the signals from the casing collar locator; and a signal generator communicably coupled to the controller to receive the plurality of distinct frequency signals from the controller and transmit the plurality of distinct frequency signals to a terranean surface through a portion of a wellbore system.

In a first aspect combinable with the general implementation, the controller includes a processor coupled to the CCL to receive the signal indicative of the casing collar on the downhole casing string; a frequency generator that generates the plurality of distinct frequency signals based on the received signal indicative of the casing collar on the downhole casing string; and a power source electrically coupled to the CCL, the processor, and the frequency generator.

In a second aspect combinable with any of the previous aspects, the frequency generator includes a voltage-controlled-oscillator (VCO).

In a third aspect combinable with any of the previous aspects, the signal generator includes a piezoelectric actuator coupled to the controller to receive the plurality of distinct frequency signals from the controller and convert the plurality of distinct frequency signals to associated mechanical vibrations.

A fourth aspect combinable with any of the previous aspects further includes a flexible diaphragm mechanically coupled to the piezoelectric actuator to generate a plurality of distinct pressure pulses based on the associated mechanical vibrations.

In a fifth aspect combinable with any of the previous aspects, the flexible diaphragm is positioned at or near an exterior housing of the downhole cement plug to transmit the plurality of distinct pressure pulses through a wellbore fluid of the wellbore system, at least a portion of the plurality of distinct pressure pulses indicative of casing collars on the downhole casing string.

A sixth aspect combinable with any of the previous aspects further includes a moveable armature mechanically coupled to the piezoelectric actuator to generate a plurality of distinct movements based on the associated mechanical vibrations.

In a seventh aspect combinable with any of the previous aspects, the moveable armature is positioned at or near an exterior housing of the downhole cement plug to contact the downhole casing string based on the plurality of distinct movements, at least a portion of the plurality of distinct pressure pulses indicative of casing collars on the downhole casing string.

In an eighth aspect combinable with any of the previous aspects, the CCL includes the piezoelectric actuator and the moveable armature mechanically coupled to the piezoelectric actuator.

In a ninth aspect combinable with any of the previous aspects, the signal generator further includes a voltage driver coupled between the VCO and the piezoelectric actuator.

In a tenth aspect combinable with any of the previous aspects, the signal generator is operable to switch from a first distinct frequency to a second distinct frequency signal based at least in part on a particular signal indicative of a casing collar.

In an eleventh aspect combinable with any of the previous aspects, the CCL includes a giant-magneto-resistance sensor.

In another general implementation, a downhole tool locating system includes a downhole tool and a control system. The downhole tool includes a locator assembly to generate data indicative of downhole wellbore locations of the downhole tool in a wellbore system; a processor communicably coupled to the locator assembly to output a plurality of distinct signals based on the generated data from the locator assembly; and a signal generator communicably coupled to the processor to receive the plurality of distinct signals from the processor and transmit the plurality of distinct signals through a portion of the wellbore system. The control system is communicably coupled with the processor to receive the plurality of distinct signals and determine a location of the downhole tool based on the plurality of distinct signals.

In a first aspect combinable with the general implementation, the locator assembly includes a casing collar locator (CCL), and the generated data includes data indicative of one or more casing collars of the wellbore system.

In a second aspect combinable with any of the previous aspects, the signal generator includes a piezoelectric actuator coupled to the controller to receive the plurality of distinct signals from the controller and convert the plurality of distinct signals to associated mechanical vibrations.

A third aspect combinable with any of the previous aspects further includes a flexible diaphragm mechanically coupled to the piezoelectric actuator to generate a plurality of distinct pressure pulses based on the associated mechanical vibrations.

In a fourth aspect combinable with any of the previous aspects, the flexible diaphragm is positioned in the downhole tool to transmit the plurality of distinct pressure pulses through a wellbore fluid of the wellbore system.

In a fifth aspect combinable with any of the previous aspects, the control system further includes one or more sensors to receive the plurality of distinct pressure pulses through the wellbore fluid, the control system operable to convert the received plurality of distinct pressure pulses to time-frequency data.

In a sixth aspect combinable with any of the previous aspects, the control system is further operable to determine the location of the downhole tool based on the time-frequency data and casing joint data.

A seventh aspect combinable with any of the previous aspects further includes a moveable armature mechanically coupled to the piezoelectric actuator to generate a plurality of distinct movements based on the associated mechanical vibrations.

In an eighth aspect combinable with any of the previous aspects, the moveable armature is positioned in the downhole tool to contact a downhole casing string of the wellbore system based on the plurality of distinct movements.

In another general implementation, a method of locating a downhole cement plug in a wellbore includes outputting, from a controller of a downhole cement plug, a first distinct frequency signal; generating, with a casing collar locator (CCL) of the downhole cement plug, a signal indicative of a casing collar of a plurality of casing collars on a downhole casing string of a wellbore system; outputting, from the controller of the downhole cement plug, a plurality of distinct frequency signals based on the signals from the casing collar locator; and transmitting the plurality of distinct frequency signals to a terranean surface through a portion of a wellbore system.

A first aspect combinable with the general implementation further includes transforming the plurality of distinct frequency signals into a plurality of pressure pulses; and transmitting the plurality of pressure pulses to the terranean surface through a fluid in a wellbore of the wellbore system.

A second aspect combinable with any of the previous aspects further includes transforming the plurality of distinct frequency signals into a plurality of mechanical vibrations; and transmitting the plurality of mechanical vibrations to the terranean surface through the downhole casing string.

In a third aspect combinable with any of the previous aspects, outputting, from the controller of the downhole cement plug, a plurality of distinct frequency signals based on the signals from the casing collar locator includes outputting a first frequency for a first time duration; outputting a second frequency different than the first frequency for a second time duration; and outputting a third frequency for a third time duration based on the signal indicative of the casing collar on the downhole casing string of the wellbore system.

In a fourth aspect combinable with any of the previous aspects, the first and second time durations are substantially equal, and the third time duration is different than the first and second time durations.

In a fifth aspect combinable with any of the previous aspects, the third frequency is substantially equal to one of the first or second frequencies.

A sixth aspect combinable with any of the previous aspects further includes receiving, at the terranean surface, the plurality of distinct frequency signals; and determining a location of the downhole cement plug in a wellbore of the wellbore system based on the plurality of distinct frequency signals.

In a seventh aspect combinable with any of the previous aspects, determining a location of the downhole cement plug in a wellbore of the wellbore system based on the plurality of distinct frequency signals includes determining a speed of the downhole cement plug in the wellbore; and determining the location of the downhole cement plug based on the determined speed.

In an eighth aspect combinable with any of the previous aspects, determining a speed of the downhole cement plug in the wellbore includes determining a particular casing collar in the plurality of casing collars based on the signal; determining a length of the downhole casing string at the particular collar based on a predetermined length of the casing string; and determining the speed of the downhole cement plug at the particular casing collar based on a ratio of the determined length of the downhole casing string at the particular casing collar and a time duration between a first casing collar in the downhole casing string and the particular casing collar of the downhole casing string.

In a ninth aspect combinable with any of the previous aspects, determining the location of the downhole cement plug based on the determined speed includes determining a time duration subsequent to a distinct frequency signal associated with the particular casing collar; and determining the location of the downhole cement plug based on a known depth of the particular casing collar and a distance that the downhole cement plug has traveled based on the determined speed of the downhole cement plug and the determined time duration.

These general and specific aspects can be implemented using a device, system or method, or any combinations of devices, systems, or methods. For example, a system of one or more computers can be configured to perform particular actions by virtue of having software, firmware, hardware, or a combination of them installed on the system that in operation causes or cause the system to perform the actions. One or more computer programs can be configured to perform particular actions by virtue of including instructions that, when executed by data processing apparatus, cause the apparatus to perform the actions. The details of one or more implementations are set forth in the accompanying drawings and the description below. Other features, objects, and advantages will be apparent from the description and drawings, and from the claims.

FIG. 1 is a diagram illustrating an example well system 100 with an example locatable downhole tool. The illustrated example system 100 includes one or more components of a cementing operation. Generally, for example, a cementing operation may seal (e.g., permanently) annular spaces between a casing and walls of a wellbore. Cement may also seal formations to prevent loss of drilling fluid and for operations ranging from setting kick-off plugs to plug and abandonment.

At the commencement of primary cementing, the pipe to be cemented and the well bore are usually filled with treatment fluid (e.g., drilling mud). In order to reduce contamination of the cement slurry at the interface between the treatment fluid and cement slurry, a plug which includes a plurality of elastomeric wipers for sealingly engaging the inner surface of the pipe is pumped ahead of the cement slurry whereby the cement slurry is separated from the treatment fluid as they are displaced through the pipe. The plug wipes the drilling mud from the walls of the pipe ahead of the cement slurry and maintains the separation between the cement slurry and treatment fluid until it lands on a float collar or float shoe attached to the bottom end of the pipe.

The bottom plug can include a rupturable member or when it lands it can open a valve mechanism which allows the cement slurry to proceed through the plug and upwardly into the annular space between the pipe and the well bore. When the required quantity of the cement slurry has been pumped into the pipe, a top plug is released into the pipe to separate the cement slurry from additional drilling mud or other fluid used to displace the cement slurry down the pipe.

The design of the top plug may be such that when it lands on the bottom plug it shuts off fluid flow through the plug, which prevents the displacement fluid from entering the annulus. When the top plug lands, the usual practice is to continue pumping the displacement fluid into the pipe whereby the pipe is pressured up and the pipe and associated equipment including the pump are pressure tested for leaks or other defects. A valve in the float collar or float shoe prevents the reverse movement of the cement slurry through the pipe. Once the cement has set, the top and bottom plugs are usually drilled out of the pipe.

The example well system 100 includes a wellbore 102 defined in a subterranean formation below a terranean surface 144 (as illustrated a bottom portion of FIG. 1 is zoomed-in relative to a top portion). The wellbore 102 can include any combination of horizontal, vertical, curved, and/or slanted sections, including a lateral wellbore, multilaterals, or other configurations. Further, although shown on the terranean surface 144, the system 100 may be located in a sub-sea or water-based environment. For example, in some implementations, a drilling assembly used to create the wellbore 102 may be deployed on a body of water rather than the terranean surface 144. For instance, in some implementations, the terranean surface 144 may be an ocean, gulf, sea, or any other body of water under which hydrocarbon-bearing formations may be found. In short, reference to the terranean surface 144 includes both land and water surfaces and contemplates forming and/or developing one or more deviated wellbore systems 100 from either or both locations.

The wellbore 102, in this example, includes a casing 106, which may be cemented in the wellbore 102. The casing 106 includes multiple casing sections 106A, 106B, 106C, 106D, and 106E connected end-to-end by a casing collar 107. The casing sections 106A, 106B, 106C, 106D, and 106E of the casing string 106 and the collars connecting the casing sections (e.g., the collar 107) can be made of steel or an iron alloy, and hence may exhibit a fairly high magnetic permeability and a relatively low magnetic reluctance. In other words, the casing string material conveys magnetic field lines much more readily than air and most other materials.

The well system 100 includes a working string 104 configured to be deployed in the wellbore 102. The working string 104, in this example, terminates above the surface 144. The working string 104 includes a tubular conduit of jointed and/or coiled tubing configured to transfer materials into and/or out of the wellbore 102. For example, the working string 104 can communicate displacement fluid 108 into or through a portion of the wellbore 102. Within the context example, which illustrates a cement job, the displacement fluid 108, may be a drilling mud used to force a cement slurry 110 out of the working string 104 and into an annulus between the wellbore 102 and the working string 104. The working string 104 can also communicate other types of fluids, such as the cement slurry 110 and drilling fluid 112. The working string 104 can be in fluid communication with a fluid supply source. Example fluid supply sources include a pressurized tank and/or a surface compressor. In other instances, the working string 104 may be deployed in and out of the wellbore 102 via a wire (e.g., wireline, slickline, e-line, or otherwise).

The working string 104 can include one or more locatable downhole tools. Generally, the locatable downhole tool can include a location detector that can be installed in the downhole tool. The location detector can include, in some examples, a casing collar locator (CCL), a temperature sensor, a gamma ray detector, or a different detector compatible with the well system 100. The locatable downhole tool can further include devices to measure other properties such as temperature, pressure, pH, salinity of the fluid inside the casing. Examples of locatable downhole tools in the example working string 104 can include a top plug 114, a bottom plug 116, a float collar 118, a centralizer 120, a guide shoe 124 and other downhole tools. The locatable downhole tool can be coupled to a receiver 126, to transmit and/or transfer (e.g., at the surface 144) a signal generated by the location detector.

In some implementations, the locatable downhole tool can automatically generate a surface detectable signal in the working string 104 each time the casing collar locator moves through a pipe casing collar. The depth of locatable downhole tool can be measured (e.g., continuously or at particular intervals) by the surface receiver 126. The measured depth of the locatable downhole tool corresponds to the detected signal that is recorded to produce an accurate record of the depth of each detected casing collar.

In some implementations, the locatable downhole tool is programmed at the surface to store acquired casing collar data in a downhole memory and to transmit this data to the surface after a programmed time delay. As the locatable downhole tool is passed through each casing collar, the locatable downhole tool generates a signal which is stored in the downhole memory as a function of time. Concurrently, a depth sensor measures and transmits the depth data to a surface receiver. For example, after a surface programmed time delay has expired, the data in downhole memory is transmitted to the surface as a function of time and it is detected by the surface receiver 126.

The receiver 126 can be a pressure transducer, an accelerometer, a geophone, or any other type of receiver compatible with the well system 100. The receiver 126 can be coupled to a control system 128, to process (e.g., at the surface 144) the signal generated by the location detector. The control system 128 are configured to process the signal generated by the location detector and to perform particular actions to control the flow of a fluid through casing, based on the determined location of the locatable downhole tools. In instances where the locatable downhole tool is the top plug 114, the control system 128 can be used to control the volumetric flow of the displacement fluid 108 during primary cementing.

Figure 2:
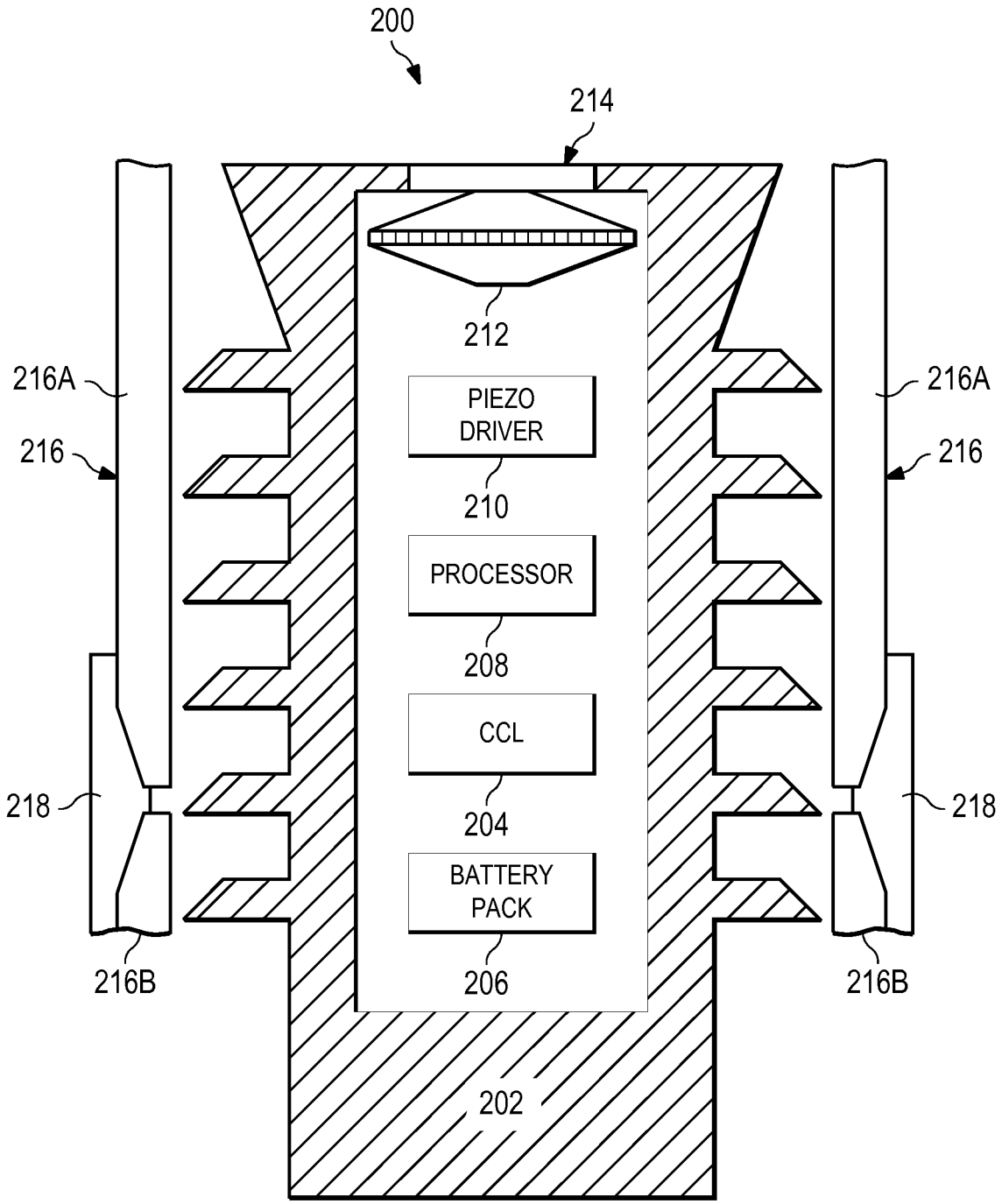
FIG. 2 illustrates an example implementation of a locatable downhole cement plug.
Figure 3:
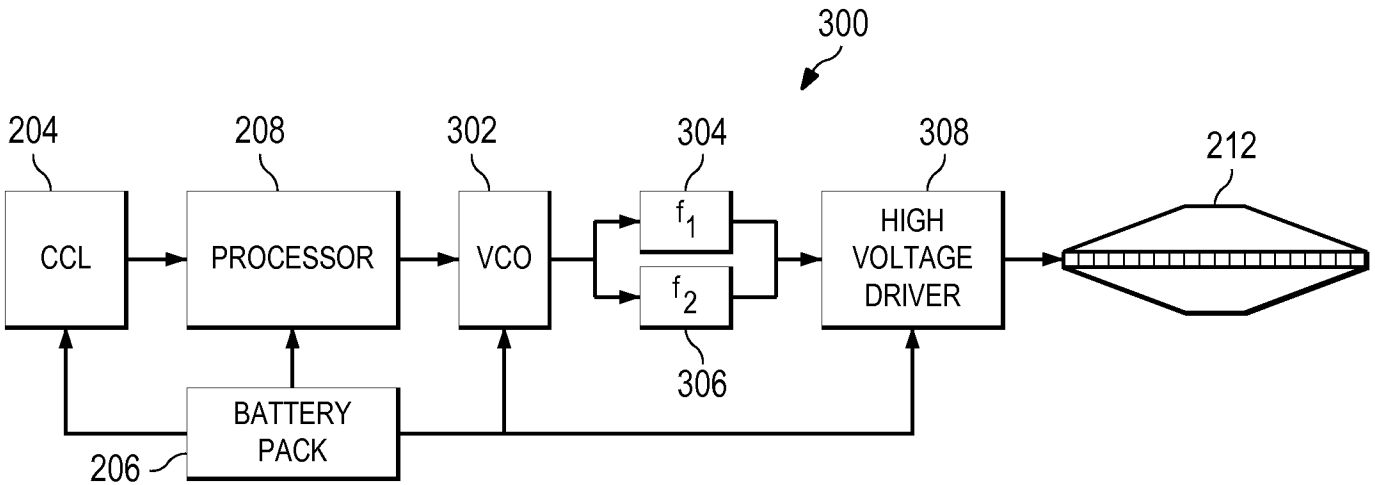
FIG. 3 illustrates a schematic block diagram of the locatable downhole cement plug of FIG. 2.

FIGS. 2 and 3 are a schematic representation and a block diagram 300, respectively of an example implementation of a locatable downhole cement plug 200. The illustrated locatable downhole cement plug 200 (which can be implemented as the plug 114 shown in FIG. 1, for example) can include a housing 202 and a CCL 204 that is configured to detect (e.g. continuously) one or more casing collars 218 that couple casing sections 216A and 216B (e.g., threadingly or otherwise). For example, a casing 216 may be made of multiple casing sections 216A and 216B (e.g., sections 216A and 216B) of pipe that are coupled together during deployment into a wellbore.

A casing collar 218 connects two casing sections 216A and 216B (e.g., threadingly or otherwise) to form a connection that is sufficient with respect to mechanical strength and hydraulic isolation (e.g., between the inside and outside of the formed casing). The CCL 204, in some examples, is an electric logging tool that detects a magnetic anomaly caused by the relatively high mass of the casing collar 218 relative to the casing sections 216A and 216B.

The casing sections 216A and 216B have a variety of lengths. Thus, the number of casing sections 216A and 216B (and their associated lengths) that make up a casing is known prior to and/or after deployment of the casing 216 in the wellbore. In addition, a position of each section within the overall casing 216 is known prior to and/or after deployment of the casing 216 in the wellbore.

The CCL 204 can be built into the housing 202 or attached to the locatable downhole cement plug 200. The locatable downhole cement plug 200 can generate a probing electromagnetic field via several possible manners, including electro-magnetic and acoustic methods. For example, the CCL 204 can include two permanent magnets with opposing poles that are positioned on the end of a central coil. The passage of the CCL 204 through a casing collar 218 generates a distortion of the magnetic field generated by the increase in magnetic material. The change in magnetic field with time produces a current in the coil which can be detected by electronic components of the CCL 204. Alternatively, the change in magnetic field can also be detected by so called giant-magneto-resistance sensors. In yet another embodiment, such giant-magneto-resistance sensor can be used to detect magnetic anomaly naturally present at casing joints.

The locatable downhole cement plug 200 further includes a battery 206, a processor 208, a piezo driver 210, an amplified piezoelectric actuator 212 and a flexible diaphragm 214. The battery 206 can be configured to provide power during the entire duration of the cement process. The CCL 204 can use power supplied by the battery 206 to generate a signal. The processor 208, powered by the battery 206, can process the signal. The signal processing can include filtering the signal before sending it to the piezo driver 210.

In some implementations, the high voltage piezo driver 210 can include a voltage-controlled-oscillator (VCO) 302 and a high voltage driver 308. VCO 302 can generate an oscillatory signal at two or more desired frequencies 304 and 306. The frequency modulated signal can be used by the high voltage driver 308 to energize a piezoelectric stack actuator or an amplified piezoelectric actuator 212.

The amplified piezoelectric actuator 212 can generate vibrations in a flexible diaphragm 214 to transmit pressure waves through the fluid on top of the locatable downhole cement plug 200. The flexible diaphragm can be positioned at or near an exterior housing of the downhole cement plug to transmit the plurality of distinct pressure pulses through a wellbore fluid of the wellbore system, at least a portion of the plurality of distinct pressure pulses being indicative of casing collars 218 on the downhole casing string.

In an alternative embodiment, a voice coil actuator can be used as transmitter. The moving part of the voice coil is attached to the flexible diaphragm. CCL and other sensor signal can be used to modulate an alternating current which is then fed into the voice coil. This may generate vibratory motion in the voice coil and in the diaphragm.

The locatable downhole cement plug 200 creates one or more pressure waves of specified characteristics (e.g., frequency, magnitude, duration and/or other characteristics). For example, the locatable downhole cement plug 200 creates and sends a regular pressure pulse of a particular frequency at a pre-set time interval. When it passes a casing collar 218, the locatable downhole cement plug 200 generates a pressure pulse at a time that is different from the pre-set time duration. The pressure pulse generated at a distinct time indicates the location of a casing collar 218. The locatable downhole cement plug 200 can create pressure pulses that are many times greater in magnitude than the pressure of the fluid in the wellbore 102.

The locatable downhole cement plug 200 can generate the pressure waves into the fluids in the wellbore, including the treatment displacement fluid 108 or other fluids or combinations of fluids. In some implementations, the locatable downhole cement plug 200 creates energy waves with a specified frequency or frequencies of 1-20 Hz, 1-40 Hz or other. The locatable downhole cement plug 200 can be located at any position along the length of the wellbore, but in most instances, it will be located at fluid boundaries, e.g., between drilling fluid and a spacer fluid, or between spacer fluid and cement. As such fluids are pumped into the wellbore, the location of the downhole cement plug 200 will change as function of time.

In an example implementation, treatment displacement fluid 108 is continuously pumped into the wellbore 102, for example via the working string 104 and/or the annulus between the working string 104 and wellbore 102 wall, while the locatable downhole cement plug 200 is activated. A portion of the energy waves created by the locatable downhole cement plug 200 propagate through the treatment displacement fluid 108 towards the surface 144 where they can be processed by the control system 128. Thus, in the illustrated embodiment of the plug 200, a fluid column inside a drill string is used as a transmission medium through which generated energy waves at particular frequencies may travel. The energy waves are generated by the cement plug 200 as described above in response to locating a casing collar. In some aspects of the plug 200, low frequency energy waves may be preferred due to a high attention of pressure waves in fluid at high frequencies.

Figure 4:
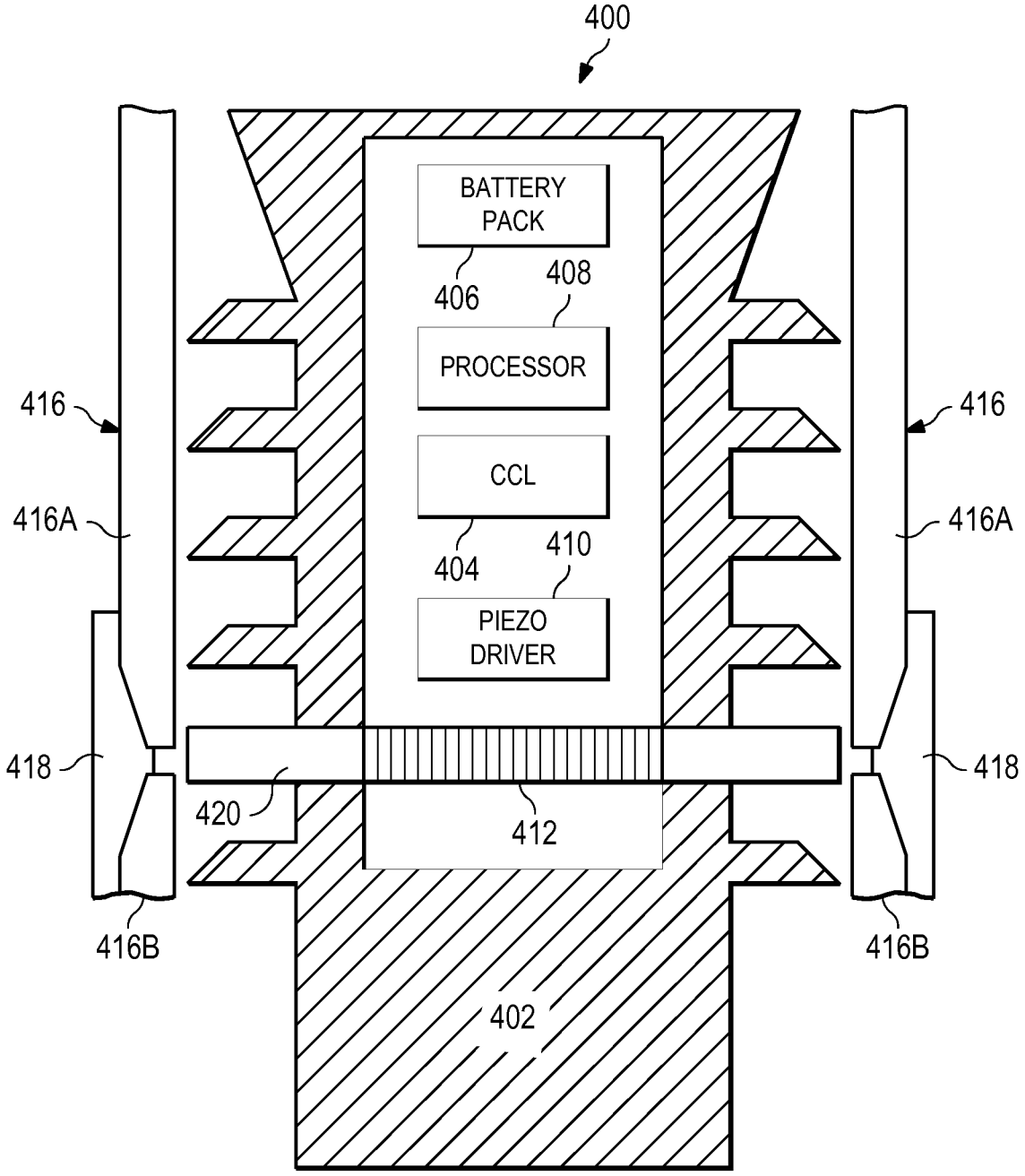
FIG. 4 illustrates another example implementation of a locatable downhole cement plug.

FIG. 4 illustrates another example implementation of a locatable downhole cement plug 400. The locatable downhole cement plug 400 includes a housing 402, a CCL 404, a battery 406, a processor 408, a piezo driver 410, and a piezoelectric stack 412. As a voltage differential is applied by the piezo driver 410 to the piezoelectric stack 412, the elements of the piezoelectric stack 412 expand axially in the moveable armature 420. The piezoelectric stack 412 then contracts when the voltage across it returns to zero. As expansion and contraction of the piezoelectric stack 412 induces a series of contacting engagements between the armature 420 and the casing 416. This contacting engagements can generate waveforms of different frequencies. Thus, the cement plug 400 may utilize the casing string as a transmission medium through which generated energy waves at particular frequencies may travel based on, for instance, a determination that the plug 400 has passed a casing collar 418 in the casing 416. In some aspects of the plug 400, higher frequencies in the passbands around 600, 900, and 1200 Hz may be used in the generated waveforms through the contacting engagements between the armature 420 and the casing 416.

The piezoelectric stack 412 may provide satisfactory high frequency signals for transmission upstream of the borehole. However, cementing applications require particular frequency signals to be transmitted upstream. Each generated signal that propagates through the treatment displacement fluid is partly transmitted and partly reflected. Some of the reflections occur at the joints between two casing sections 416A and 416B, which have a different diameter than the rest of the casing 416.

The interfaces or connections between sections of the casing may block high frequency signals, but allow low frequency signals to pass. Therefore, the piezo driver 410 of the present invention is advantageous in that it can generate two frequencies which are within the pass band of the piezoelectric stack 412. The frequencies generated by the piezoelectric stack 412 of the present invention improve the performance by providing satisfactory signals at frequencies around 600 Hz, 900 Hz or 1200 Hz, depending on the depth of the wellbore and the number of casing joints. As such, the configuration of the piezoelectric stack 412 and the characteristics of the wellbore require an accurate selection of the two frequencies with the piezo driver 410 so that waveforms are generated at particular frequencies to reach and transmit data to the surface.

The piezoelectric stack 412 is in mechanical contact with the housing 402 by pushing it out to contact the casing. The housing can include a moveable armature 420 mechanically coupled to the piezoelectric stack 412 to generate distinct movements based on the associated mechanical vibrations. For example, the moveable armature can be positioned at or near an exterior housing of the downhole cement plug to contact the downhole casing 416 at multiple distinct movements, at least a portion of the plurality of distinct pressure pulses indicative of casing collars 418 on the downhole casing string.

In some aspects of the plug 400, the armature 420 and the piezoelectric stack 412 may function as a casing collar locator in place of, or in addition to, the CCL 404. For example, as the armature 420 is moved over the casing 416 and also over/through a particular collar 418, there will be a change in mechanical stress in the armature 420. The piezoelectric stack 412 may also experience a change in stress and consequently generate a signal in the stack 412 that is indicative of a collar 418. Therefore, the plug 400 may be run in two modes. In a first mode (e.g., a detection mode), an output of the stack 412 is passively (e.g., not energized) monitored as a collar signal. In a second mode (e.g., a transmission mode), oscillating high voltage is applied to the piezoelectric stack 412 to generate vibration in the casing 416 in desired frequencies to transmit a signal (e.g., an indication of a collar 418) uphole.

Figure 5:
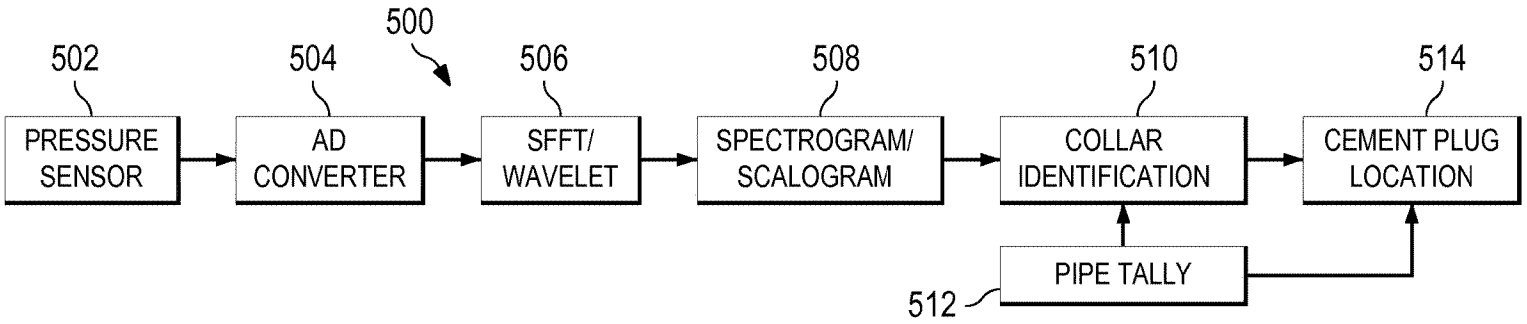
FIG. 5 illustrates an example process flow of a control system that is communicably coupled to a locatable downhole tool.

FIG. 5 illustrates an example process flow of a control system 500 that is communicably coupled to a locatable downhole tool (e.g., as described with reference to the control system 128 of FIG. 1). The control system 500 includes a pressure sensor 502, an AD converter 504, a short-time fast Fourier/wavelet processor 506, a spectrogram/scalogram 508, a collar identification 510, a cement plug location 514 and a pipe tally 512. The pressure sensor 502 can be the receiver 126 described with reference to FIG. 1. The pressure sensor 502 receives signals transmitted by a locatable downhole tool that are generated and transmitted through the treatment fluid, as described with reference to FIGS. 1-4. In some implementations, the output of the pressure sensor 502 is an analog signal, which can be digitized by the AD converter 504. The digitized signal can be processed by the short-time fast Fourier/wavelet processor 506 using a short-time fast Fourier transform or wavelet transform.

Figure 6A:
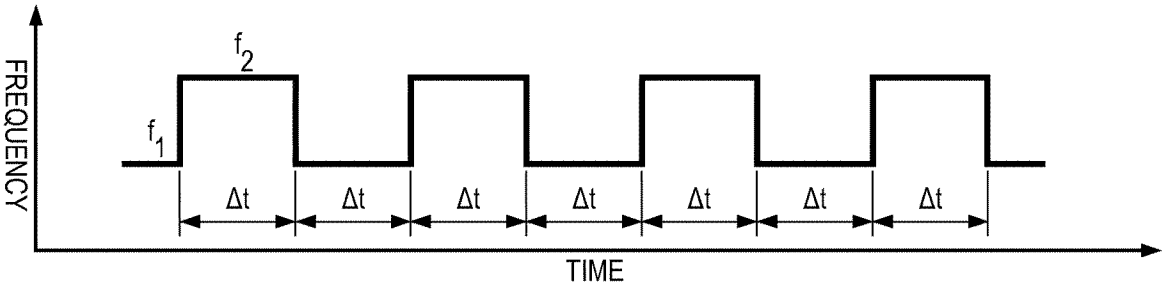
FIG. 6A illustrates an example spectrogram generated by the example process flow of FIG. 5.
Figure 6B:
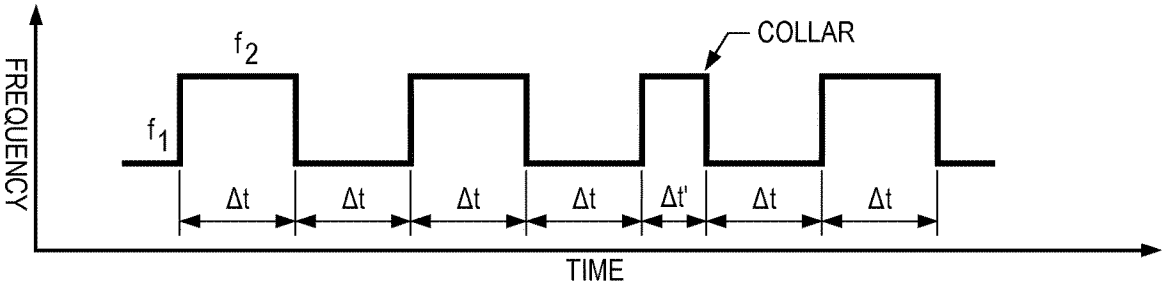
FIG. 6B illustrates another example spectrogram generated by the example process flow of FIG. 5.

The results of short-time fast Fourier/wavelet processor 506 can produce a time-frequency plot, as illustrated in FIGS. 6A and 6B. The example spectrogram shown in FIG. 6A is a time-frequency plot generated by the short-time fast Fourier/wavelet processor 506 based on a signal received from the locatable downhole tool (e.g., the top plug 114 in FIG. 1) during its descent through a region of the casing without a casing collar. For example, the locatable downhole tool periodically transmits at two alternative frequencies $f_1$ and $f_2$ to act as a timing clock (as they transmitted exactly same interval) in the absence of any casing collars.

FIG. 6B is a time-frequency plot generated by the short-time fast Fourier/wavelet processor 506 based on a signal received from the locatable downhole tool (e.g., the top plug 114 in FIG. 1) during its descent through a region of the casing including a casing collar. When the locatable downhole tool detects a casing collar, the frequency is switched as indicated by FIG. 6B. The frequency switch can be used by collar identification 510 to accurately provide the location of the locatable downhole tool.

The collar identification 510 processes the signal based on time-frequency information. The collar identification 510 can be coupled with known casing pipe tally 512 to provide the final cement plug location 514. For example, given the known casing pipe tally, the speed of the cement plug can be calculated by counting the number of clock changes (e.g., the number of frequency flips $\Delta t$'s). The cement plug speed is $V_{plus}=L/T$, where L is the known collar length between the (m−1) and m-th collars in the casing string tally and $T=n*\Delta T+\Delta t'$, which represents the travel time between the (m−1) and m-th collars, with n being the total number of complete clock cycles counted from last collar. With the cement plug speed known, it is possible to determine the location (e.g., depth or TVD), $Z_{plug}$, of the plug:

$$Z_{plug}=Z_m+V_{plug}*\Delta t',$$

where $Z_m$ is the depth of the m-th casing collar.

The described process can be applied to determine a particular m-th casing collar in the plurality of casing collars based on the signal. The length of the downhole casing string at the particular collar can be further determined based on a predetermined length of the casing string. Following, a ratio between the determined length of the downhole casing string at the particular casing collar and a time duration between a first casing collar in the downhole casing string and the particular casing collar of the downhole casing string can be calculated to derive the speed of the downhole cement plug at the particular casing collar. A time duration subsequent to a distinct frequency signal associated with a particular casing collar can be derived using a spectrogram as indicated in FIG. 6B. The derived time duration and calculated speed can be combined to determine the location of the downhole cement plug.

Figure 7:
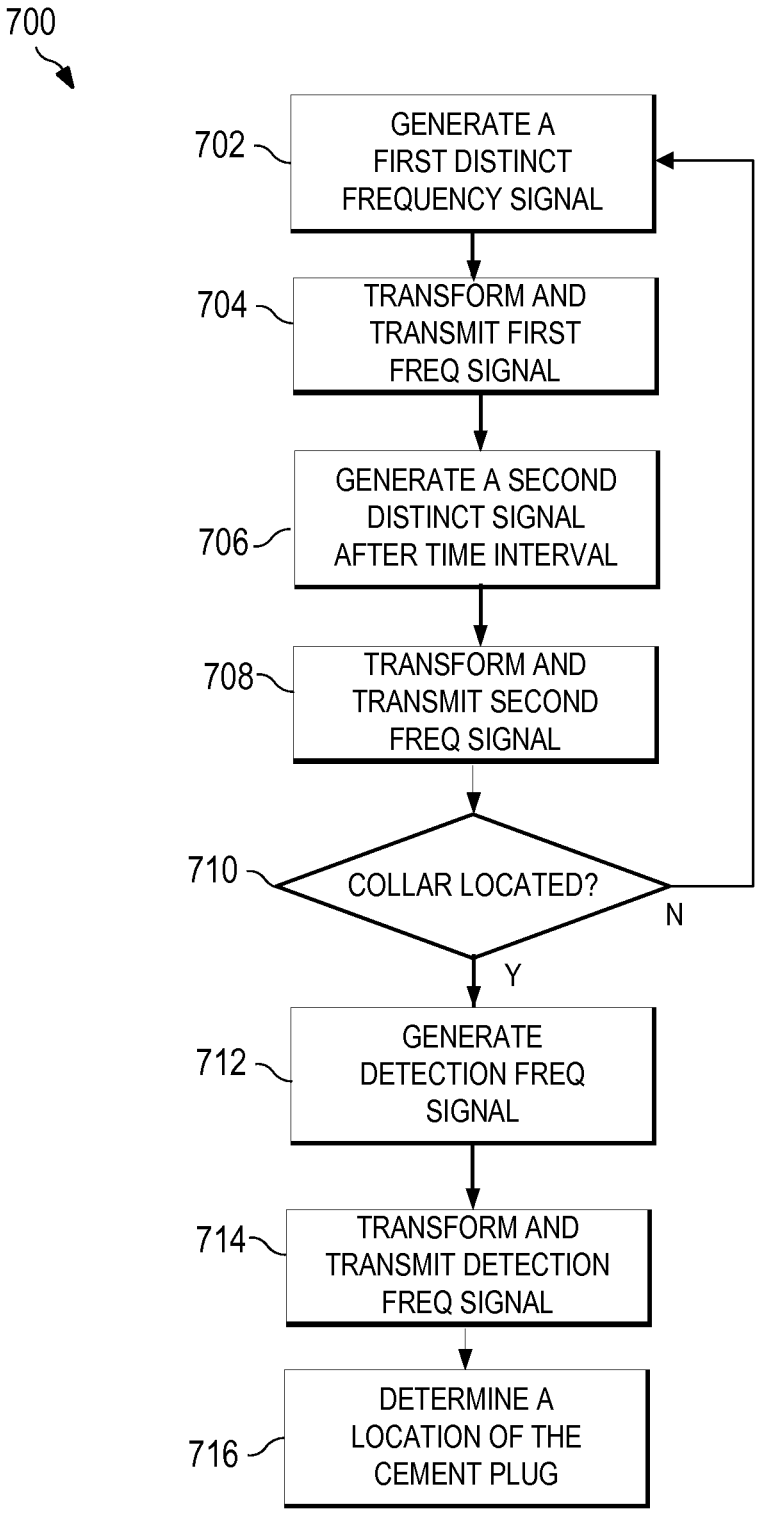
FIG. 7 illustrates a flowchart of an example process for monitoring and controlling an operation of a well flow device.

FIG. 7 is a flowchart of an example process 700 for locating a downhole cement plug in a wellbore. The process 700 can be implemented, for example, by the downhole cement plug 200, discussed with reference to FIGS. 2-3 (but can also be implemented with the downhole cement plug 114, 400, or other implementation in accordance with the present disclosure). At step 702, a controller of a downhole cement plug outputs a first distinct frequency signal (for example 304 in FIG. 3).

At step 704, the first frequency signal is transformed, e.g., by a signal generator, that is communicably coupled to a processor 208 of the plug 200, to other types of signals appropriate for transmission. For example, the frequency signals can be transformed into pressure pulses or mechanical vibrations. At this step, the transformed signal is transmitted to a terranean surface through a portion of a wellbore system. For example, pressure pulses can be transmitted to the terranean surface through a fluid in a wellbore of the wellbore system. As another example, mechanical vibrations can be transmitted to the terranean surface through the downhole casing string.

After a known preset time interval, Δt, a second distinct frequency signal is generated at step 706. For example, the processor 208 changes the voltage of, for instance, VCO 302 so as to generate a second distinct frequency signal (306 in FIG. 3) at this step. At step 708, the second frequency signal is transformed and transmitted to a terranean surface through a portion of a wellbore system (as described above in step 704).

Until a casing collar is detected (e.g., by the CCL 204) in step 710, and after another preset time interval, Δt, the frequency is changed back to the first signal in step 702 (and steps 704-708 repeat). Thus, as the plug 200 travels into the well, the detected surface signal will yield a spectrogram as indicated by FIG. 6A.

This frequency flip-flop (e.g., steps 702-708) may continue until a casing collar is detected by the CCL 204 in step 710. Based on detection of a casing collar in step 710, a detection frequency signal different from that prior (e.g., in step 702) to collar detection in step 710 is then generated in step 712. This detection frequency signal may be the same as, similar to, or different that the second frequency signal but is generated at a time interval different than Δt. For example, the processor 208 may change (e.g., immediately) the voltage of VCO 302 so as to generate the detection. frequency signal. At step 714, the detection frequency signal is transformed and transmitted to a terranean surface through a portion of a wellbore system (as described above in step 704).

At the surface, a change in frequency in a detected signal, which occurs not at the predetermined time interval, Δt, is indicative of the CCL 204 encountering a casing collar (e.g., FIG. 6B). The signals are received at the terranean surface by a receiver, such as receiver 126, described with reference to FIG. 1. At step 716, the signals are processed to determine a location of the downhole cement plug in a wellbore of the wellbore system based on the detection frequency signals, as described with reference to FIG. 5.

Figure 8:
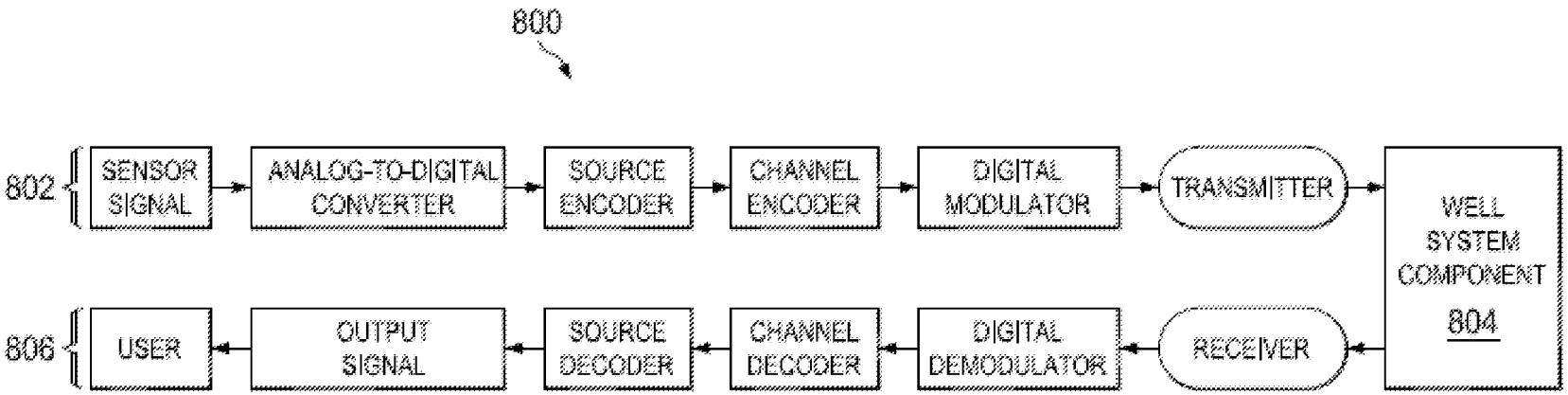
FIG. 8 illustrates an example communication system that may be implemented with a locatable downhole cement plug.

FIG. 8 illustrates an example communication system 800 that may be implemented with a locatable downhole cement plug. The communication system 800 includes one or more steps, processes, and/or components that allow a locatable downhole cement plug (or other downhole tool) to determine and/or transmit a location of the plug in a wellbore. The communication system 800, as illustrated, includes a tool component 802, a well system component 804, and a surface component 806 (which may be located at or near a terranean surface). As illustrated, the tool component 802 includes a sensor signal (e.g., CCL, gamma, temperature and pressure, or otherwise), which is converted into digital signal using an A-to-D converter, source encoded (e.g., by mapping sensor digital data into a sequence of binary stream), channel encoded (e.g., by introducing redundancy in the binary stream to overcome the effects of noise and/or interference in well system component 804), and digitally modulated (e.g., in order to map the binary information stream into communication carrier waveforms) to then be fed into the transmitter. The adjusted signal is transmitted through the well system component 804 (e.g., a fluid such as a drilling mud or other wellbore fluid, a wellbore tubing, or other component). As illustrated, the surface component 806 adjusts the signal received through the well system component 804 in reverse as it is adjusted by the tool component 802. Thus, a user of the surface component 806 may receive a signal indicative of a wellbore location of the downhole cement plug.

The features described can be implemented in digital electronic circuitry, or in computer hardware, firmware, software, or in combinations of them, for example, the control system 128. The apparatus can be implemented in a computer program product tangibly embodied in an information carrier, e.g., in a machine-readable storage device, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. Elements of a computer can include a processor for executing instructions and one or more memories for storing instructions and data. Generally, a computer can also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

A number of examples have been described. Nevertheless, it will be understood that various modifications may be made. Accordingly, other examples are within the scope of the following claims.

What is claimed is:

1. A downhole cement plug, comprising:

a casing collar locator (CCL) operable to generate signals indicative of casing collars on a downhole casing string of a wellbore system;

a controller communicably coupled to the CCL and operable to continuously output a plurality of distinct frequency signals that alternate between a first frequency and a second frequency based on presences of the casing collars using the signals from the casing collar locator, wherein the plurality of distinct frequency signals alternate between the first frequency and the second frequency at a first preset interval when a casing collar is not detected and alternate between the first frequency and the second frequency at a second interval when at least one of the casing collars is detected, the first preset interval being different from the second interval; and a signal generator communicably coupled to the controller and operable to receive the plurality of distinct frequency signals from the controller and continuously transmit the plurality of distinct frequency signals to a terranean surface through a portion of the wellbore system.

2. The downhole cement plug of claim 1, wherein the controller comprises:

a processor coupled to the CCL to receive the signal indicative of the casing collar on the downhole casing string;

a frequency generator that generates the plurality of distinct frequency signals based on the received signal indicative of the casing collar on the downhole casing string; and a power source electrically coupled to the CCL, the processor, and the frequency generator.

3. The downhole cement plug of claim 2, wherein the frequency generator comprises a voltage-controlled-oscillator (VCO).

4. The downhole cement plug of claim 3, wherein the signal generator further comprises a piezoelectric actuator, and a voltage driver is coupled between the VCO and the piezoelectric actuator.

5. The downhole cement plug of claim 1, wherein the signal generator comprises:

a piezoelectric actuator coupled to the controller to receive the plurality of distinct frequency signals from the controller and convert the plurality of distinct frequency signals to associated mechanical vibrations.

6. The downhole cement plug of claim 5, further comprising a flexible diaphragm mechanically coupled to the piezoelectric actuator to generate a plurality of distinct pressure pulses based on the associated mechanical vibrations, the flexible diaphragm positioned at or near an exterior housing of the downhole cement plug to transmit the plurality of distinct pressure pulses through a wellbore fluid of the wellbore system, at least a portion of the plurality of distinct pressure pulses indicative of casing collars on the downhole casing string.

7. The downhole cement plug of claim 5, further comprising a moveable armature mechanically coupled to the piezoelectric actuator to generate a plurality of distinct movements based on the associated mechanical vibrations, the moveable armature positioned at or near an exterior housing of the downhole cement plug to contact the downhole casing string based on the plurality of distinct movements, at least a portion of the plurality of distinct pressure pulses indicative of casing collars on the downhole casing string.

8. The downhole cement plug of claim 7, wherein the CCL comprises the piezoelectric actuator and the moveable armature mechanically coupled to the piezoelectric actuator.

9. The downhole cement plug of claim 1, wherein the signal generator is operable to switch from a first distinct frequency to a second distinct frequency signal based at least in part on a particular signal indicative of a casing collar.

10. The downhole cement plug of claim 1, wherein the CCL comprises a giant-magneto-resistance sensor.

11. A downhole tool locating system, comprising:

a downhole tool, comprising:

a locator assembly operable to generate data indicative of downhole wellbore locations of the downhole tool in a wellbore system;

a processor communicably coupled to the locator assembly and operable to continuously output a plurality of distinct signals that alternate between a first frequency and a second frequency based on a presence of a casing collar using the generated data from the locator assembly, wherein the plurality of distinct signals alternate between the first frequency and the second frequency at a first preset interval when the casing collar is not detected and alternate between the first frequency and the second frequency at a second interval when the casing collar is detected, the first preset interval being different from the second interval; and a signal generator communicably coupled to the processor and operable to receive the plurality of distinct signals from the processor and continuously transmit the plurality of distinct signals through a portion of the wellbore system; and a control system communicably coupled with the processor to receive the plurality of distinct signals and determine a location of the downhole tool based on the plurality of distinct signals.

12. The downhole tool locating system of claim 11, wherein the locator assembly comprises a casing collar locator (CCL), and the generated data comprises data indicative of one or more casing collars of the wellbore system.

13. The downhole tool locating system of claim 11, wherein the signal generator comprises a piezoelectric actuator coupled to the controller to receive the plurality of distinct signals from the controller and convert the plurality of distinct signals to associated mechanical vibrations.

14. The downhole tool locating system of claim 13, further comprising a flexible diaphragm mechanically coupled to the piezoelectric actuator to generate a plurality of distinct pressure pulses based on the associated mechanical vibrations, the flexible diaphragm positioned in the downhole tool to transmit the plurality of distinct pressure pulses through a wellbore fluid of the wellbore system.

15. The downhole tool locating system of claim 14, wherein the control system further comprises one or more sensors to receive the plurality of distinct pressure pulses through the wellbore fluid, the control system operable to convert the received plurality of distinct pressure pulses to time-frequency data.

16. The downhole tool locating system of claim 15, wherein the control system is further operable to determine the location of the downhole tool based on the time-frequency data and casing joint data.

17. The downhole tool locating system of claim 13, further comprising a moveable armature mechanically coupled to the piezoelectric actuator to generate a plurality of distinct movements based on the associated mechanical vibrations, the moveable armature positioned in the downhole tool to contact a downhole casing string of the wellbore system based on the plurality of distinct movements.

18. A method of locating a downhole cement plug in a wellbore, comprising:

generating, with a casing collar locator (CCL) of a downhole cement plug, a signal indicative of a casing collar of a plurality of casing collars on a downhole casing string of a wellbore system;

continuously outputting, from a controller of the downhole cement plug, a plurality of distinct frequency signals that alternate between a first frequency and a second frequency based on a presence of the casing collar using the signal from the CCL, wherein the first and second frequencies alternate at a first preset interval when the casing collar is not detected and alternate at a second interval when at least one of the casing collars is detected, the first preset interval being different from the second interval; and continuously transmitting the plurality of distinct frequency signals to a terranean surface through a portion of the wellbore system.

19. The method of claim 18, further comprising:

transforming the plurality of distinct frequency signals into a plurality of pressure pulses; and transmitting the plurality of pressure pulses to the terranean surface through a fluid in a wellbore of the wellbore system.

20. The method of claim 18, further comprising:

transforming the plurality of distinct frequency signals into a plurality of mechanical vibrations; and transmitting the plurality of mechanical vibrations to the terranean surface through the downhole casing string.

21. The method of claim 18, wherein outputting, from the controller of the downhole cement plug, a plurality of distinct frequency signals based on the signal from the CCL comprises:

outputting the first frequency for a first time duration;

outputting the second frequency different than the first frequency for a second time duration; and outputting a third frequency for a third time duration based on the signal indicative of the casing collar on the downhole casing string of the wellbore system.

22. The method of claim 21, wherein the first and second time durations are substantially equal, and the third time duration is different than the first and second time durations.

23. The method of claim 21, wherein the third frequency is substantially equal to one of the first or second frequencies.

24. The method of claim 18, further comprising:

receiving, at the terranean surface, the plurality of distinct frequency signals; and determining a location of the downhole cement plug in a wellbore of the wellbore system based on the plurality of distinct frequency signals.

25. The method of claim 24, wherein determining a location of the downhole cement plug in a wellbore of the wellbore system based on the plurality of distinct frequency signals comprises:

determining a speed of the downhole cement plug in the wellbore; and determining the location of the downhole cement plug based on the determined speed.

26. The method of claim 25, wherein determining a speed of the downhole cement plug in the wellbore comprises:

determining a particular casing collar in the plurality of casing collars based on the signal;

determining a length of the downhole casing string at the particular collar based on a predetermined length of the casing string; and determining the speed of the downhole cement plug at the particular casing collar based on a ratio of the determined length of the downhole casing string at the particular casing collar and a time duration between a first casing collar in the downhole casing string and the particular casing collar of the downhole casing string.

27. The method of claim 26, wherein determining the location of the downhole cement plug based on the determined speed comprises:

determining a time duration subsequent to a distinct frequency signal associated with the particular casing collar; and determining the location of the downhole cement plug based on a known depth of the particular casing collar and a distance that the downhole cement plug has traveled based on the determined speed of the downhole cement plug and the determined time duration.

* * * * *